US009302525B2

(12) United States Patent
Oguri et al.

(10) Patent No.: US 9,302,525 B2
(45) Date of Patent: Apr. 5, 2016

(54) RECORDING MEDIUM AND PROCESS FOR PRODUCING THE SAME

(71) Applicant: CANON KABUSHIKI KAISHA, Tokyo (JP)

(72) Inventors: Isamu Oguri, Yokohama (JP); Yasuhiro Nito, Inagi (JP); Kazuhiko Araki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/554,480

(22) Filed: Nov. 26, 2014

(65) Prior Publication Data

US 2015/0174937 A1 Jun. 25, 2015

(30) Foreign Application Priority Data

Dec. 24, 2013 (JP) ..... 2013-265291

(51) Int. Cl.
*B41M 5/40* (2006.01)
*B41M 5/50* (2006.01)

(52) U.S. Cl.
CPC ..... *B41M 5/506* (2013.01); *B41M 5/502* (2013.01); *B41M 5/504* (2013.01); *B41M 5/508* (2013.01); *B41M 2205/34* (2013.01); *B41M 2205/36* (2013.01); *B41M 2205/38* (2013.01); *B41M 2205/42* (2013.01)

(58) Field of Classification Search
CPC ..... B41M 5/502; B41M 5/504; B41M 5/506; B41M 5/508; B05D 1/00
See application file for complete search history.

(56) References Cited

U.S. PATENT DOCUMENTS

| | | | |
|---|---|---|---|
| 6,874,881 | B2 | 4/2005 | Shirota et al. |
| 6,929,362 | B2 | 8/2005 | Takada et al. |
| 6,932,465 | B2 | 8/2005 | Nito et al. |
| 6,935,732 | B2 | 8/2005 | Takada et al. |
| 7,029,109 | B2 | 4/2006 | Shirota et al. |
| 7,055,943 | B2 | 6/2006 | Suzuki et al. |
| 7,208,032 | B2 | 4/2007 | Hakamada et al. |
| 7,276,110 | B2 | 10/2007 | Tsujimura et al. |
| 7,276,112 | B2 | 10/2007 | Tokuda et al. |
| 7,347,890 | B2 | 3/2008 | Nito et al. |
| 7,354,145 | B2 | 4/2008 | Nito et al. |
| 7,377,631 | B2 | 5/2008 | Takada et al. |
| 7,402,200 | B2 | 7/2008 | Imai et al. |
| 7,517,073 | B2 | 4/2009 | Nito et al. |
| 7,517,074 | B2 | 4/2009 | Hakamada et al. |
| 7,537,329 | B2 | 5/2009 | Nito et al. |
| 7,635,182 | B2 | 12/2009 | Hakamada et al. |
| 8,016,406 | B2 | 9/2011 | Hakamada et al. |
| 8,252,392 | B2 | 8/2012 | Oguri et al. |
| 8,486,499 | B2 | 7/2013 | Nito et al. |
| 8,524,336 | B2 | 9/2013 | Oguri et al. |
| 8,609,209 | B2 | 12/2013 | Taguri et al. |
| 8,795,798 | B2 | 8/2014 | Oguri et al. |
| 8,846,166 | B2 | 9/2014 | Herlambang et al. |
| 2008/0152827 | A1 | 6/2008 | Hakamada et al. |

FOREIGN PATENT DOCUMENTS

| | | | | |
|---|---|---|---|---|
| JP | S61-10483 | A | 1/1986 | |
| JP | 2004-284146 | * | 10/2004 | ..... B41M 5/00 |
| JP | 2004-284146 | A | 10/2004 | |
| JP | 2004-284148 | A | 10/2004 | |
| JP | 2005-246962 | A | 9/2005 | |

OTHER PUBLICATIONS

Feb. 17, 2015 European Search Report in European Patent Appln. No. 14004138.5.

* cited by examiner

*Primary Examiner* — Betelhem Shewareged
(74) *Attorney, Agent, or Firm* — Fitzpatrick, Cella, Harper & Scinto

(57) ABSTRACT

A recording medium including a first resin layer, a porous undercoating layer and a first ink-receiving layer provided in this order on one surface of a base and including a second resin layer and a second ink-receiving layer provided in this order on the other surface of the base, wherein 60° specular glossinesses of a surface of the first resin layer closer to the first ink-receiving layer and a surface of the second resin layer closer to the second ink-receiving layer are each 65% or more, and the porous undercoating layer has a thickness of 3 μm or less.

6 Claims, No Drawings

RECORDING MEDIUM AND PROCESS FOR PRODUCING THE SAME

BACKGROUND OF THE INVENTION

1. Field of the Invention

The present invention relates to a recording medium and a process for producing the same.

2. Description of the Related Art

In the field of recent commercial printing, an on-demand photograph collection in which chosen photographs or photographs accompanied with characters are collected, namely, a photo book or a photo album, is recently bound as a booklet. In such a booklet, there is a demand for such a usage as arranging images on both surfaces of one sheet. Accordingly, a recording medium applicable to printing on both surfaces, in particular, an ink jet recording medium having high glossiness on both surfaces has been demanded. In order to attain a highly glossy ink jet recorded surface, it is effective to use a smooth base.

Japanese Patent Application Laid-Open No. 2004-284146 discloses an ink jet recording medium obtained by coating both surfaces of a paper sheet with a polyolefin resin and further providing an undercoating layer mainly made of a hydrophilic polymer and a porous ink-absorbing layer in this order on the polyolefin resin. The front surface of the polyolefin resin coating layer having the porous ink-absorbing layer thereon is subjected to a fine roughening treatment, and the front surface of the undercoating layer has a 75° specular glossiness of 30% or more and 80% or less.

Japanese Patent Application Laid-Open No. 2004-284148 discloses an ink jet recording medium including a polyolefin resin coating layer, an undercoating layer containing a hydrophilic polymer and a porous ink-absorbing layer all formed on both surfaces of a paper base. In the front surface of the polyolefin resin coating layer having the porous ink-absorbing layer thereon, the filtered maximum waviness and central line average roughness Ra are controlled. Specifically, the filtered maximum waviness determined according to JIS B 0610 (a low band cut-off value of 8 mm, a high band cut-off value of 0.8 mm and a reference length of 80 mm) is controlled to be 1 μm or more and 3 μm or less. Besides, the central line average roughness Ra determined according to JIS B 0601 (a reference length of 2.5 mm and a cut-off value of 0.8 mm) is controlled to be 0.1 μm or more and 0.5 μm or less.

On the other hand, for improving the productivity, a recording medium is generally produced into a long sheet shape and then the sheet-shaped recording medium is cut into a desired size to obtain a product. Therefore, in order that the production can be performed in a space-saving manner, the production process includes a step of winding the sheet-shaped recording medium into a roll, and various methods have been proposed for stabilizing this process.

Japanese Patent Application Laid-Open No. 2005-246962 discloses a method for winding, into a roll, a long web of an ink jet recording medium including a raw paper having both surfaces coated with a polyolefin resin, and an ink-receiving layer that is formed on each polyolefin resin coating and contains an inorganic particle and a hydrophilic binder. In this method, when the winding tension upon winding of the recording medium is T (Kgf/m) and the thickness of the ink-receiving layer is t (m), the recording medium is wound up with the value A that is expressed as $A=T\times t\times 1000$ being within the range of 0.5 or more and 3 or less.

SUMMARY OF THE INVENTION

In an embodiment, the present invention relates to a recording medium including a first resin layer, a porous undercoating layer and a first ink-receiving layer provided in this order on one surface of a base and includes a second resin layer and a second ink-receiving layer provided in this order on the other surface of the base, in which 60° specular glossinesses of a surface of the first resin layer closer to the first ink-receiving layer and a surface of the second resin layer closer to the second ink-receiving layer are each 65% or more, and the porous undercoating layer has a thickness of 3 μm or less.

In another embodiment, the present invention relates to a process for producing a recording medium, including forming a first resin layer having a 60° specular glossiness of 65% or more on one surface of a base and forming a second resin layer having a 60° specular glossiness of 65% or more on the other surface of the base; forming a porous undercoating layer having a thickness of 3 μm or less on the first resin layer; winding up into a roll the base which has been provided with the first and second resin layers and the porous undercoating layer; and forming a first ink-receiving layer on the porous undercoating layer of the base and forming a second ink-receiving layer on the second resin layer of the base after winding up the base into a roll.

Further features of the present invention will become apparent from the following description of exemplary embodiments.

DESCRIPTION OF THE EMBODIMENTS

Preferred Embodiments of the Present Invention will now be described in detail in accordance.

In order to obtain a recording medium having high glossiness on both surfaces, it is effective to provide a smooth layer on each of the surfaces of a base as described above. If such a layer is provided, however, when the front surface and the back surface of the recording medium are brought into contact with each other in a winding process, slippage between the front surface and the back surface or release conditions of air trapped between the front surface and the back surface are impaired, which may impair the shape of the resultant roll in some cases. As a result, the sheet may be deformed in some cases.

On the other hand, the slippage and the air releasing conditions between the front surface and the back surface of the recording medium can be improved by roughening the front surface of the base, but in this case, a problem is caused in which high glossiness cannot be attained. Besides, in this case, bubbles are generated in applying a coating liquid for the ink-receiving layer, and hence, a defect may be caused in the coated surface of the ink-receiving layer in some cases.

The present invention was achieved in consideration of the above-described problems. Specifically, an object of the present invention is to provide a recording medium that has high glossiness on both surfaces, shows good windability in a winding process and contains no defect in a first ink-receiving layer and to provide a process for producing the same.

The recording medium and the process for producing the same according to the present invention will now be described based on an embodiment thereof. It is noted that the present invention is not limited to the following description.

1. Recording Medium

A recording medium of the present embodiment includes a first resin layer, a porous undercoating layer and a first ink-receiving layer in this order on one surface of a base, and includes a second resin layer and a second ink-receiving layer in this order on the other surface of the base. The surface of the first resin layer closer to the first ink-receiving layer and the surface of the second resin layer closer to the second ink-receiving layer each have a 60° specular glossiness of 65% or more, and the porous undercoating layer has a thickness of 3 μm or less.

The recording medium of the present embodiment has the first and second resin layers both having the 60° specular glossiness of 65% or more. Accordingly, the glossiness of the both surfaces of the recording medium can be high.

Besides, since the porous undercoating layer is provided at least between the first resin layer and the first ink-receiving layer, fine irregularities and voids are formed. Therefore, the air can be satisfactorily released from between the front surface and the back surface of the recording medium being wound in the winding process, and in addition, the friction coefficient between the front surface and the back surface can be lowered. As a result, the shape of a roll obtained by winding the recording medium can be satisfactorily retained, and hence, good windability can be attained.

Besides, if the thickness of the porous undercoating layer exceeds 3 μm, gas-liquid exchange is caused between the air contained in the porous undercoating layer and a coating liquid for the first ink-receiving layer in applying and forming the first ink-receiving layer on the porous undercoating layer. Accordingly, if the amount of the air is large, bubbles are generated, which may cause a defect in the coated surface of the first ink-receiving layer in some cases. Therefore, in the present embodiment, the thickness of the porous undercoating layer is set to 3 μm or less, and thus, the occurrence of a defect in the first ink-receiving layer can be prevented.

Incidentally, the application of the recording medium of the present embodiment is not especially limited, but the recording medium can be an ink jet recording medium to be employed for an ink jet recording method. The ink jet recording method is a method in which an image is recorded on a recording medium by ejecting an ink from an ink jet recording head. Examples of a method for ejecting an ink include a method for applying mechanical energy to the ink and a method for applying thermal energy to the ink. In the present embodiment, the ink jet recording method utilizing thermal energy can be employed. The ink jet recording method may include any known processes as long as the recording medium of the present embodiment is used.

The respective layers included in the recording medium will now be described in detail.

Base

A specific example of the base is a base paper. The type of the base paper is not especially limited, a generally used paper may be used, and a smooth raw paper such as one used as a base for a photograph can be suitably used. As a pulp constituting the raw paper, one of or a mixture of two or more of natural pulp, recycled pulp, synthetic pulp and the like can be used. The raw paper may contain any additives generally used for papermaking, such as a sizing agent, a paper strengthening additive, a filler, an antistatic agent, a fluorescent whitening agent and a dye. Besides, the front surface of the base paper may be coated with a front surface sizing agent, a surface strengthening agent, a fluorescent whitening agent, an antistatic agent, a dye, an anchoring agent or the like.

The thickness of the base can be 50 μm or more. If the thickness is 50 μm or more, reduction in tensile strength and tear strength can be effectively prevented, and degradation in texture can be also effectively prevented. Incidentally, although there is no upper limit in the thickness of the base, the thickness can be 350 μm or less. If the thickness is 350 μm or less, inconvenience in handling the recording medium can be effectively prevented, and cost increase can be also effectively avoided.

Furthermore, a base having been subjected, during or after paper making, to a surface treatment such as compression with a pressure applied by a calendar or the like to attain good surface smoothness can be used, and the density of the base can be 0.6 g/cm$^3$ or more and 1.2 g/cm$^3$ or less. If the density is 1.2 g/cm$^3$ or less, reduction in cushioning characteristics can be effectively prevented, and in addition, decrease in stiffness can be effectively avoided and occurrence of a problem in transportation properties can be effectively prevented. Alternatively, if the density is 0.6 g/cm$^3$ or more, reduction in the surface smoothness can be effectively prevented. The density of the base is more preferably 0.7 g/cm$^3$ or more.

First Resin Layer and Second Resin Layer

The surface of the first resin layer closer to the first ink-receiving layer and the surface of the second resin layer closer to the second ink-receiving layer each have a 60° specular glossiness of 65% or more. Since the 60° specular glossiness is 65% or more, the recording medium can attain excellent glossiness. The 60° specular glossiness of these surfaces is preferably 70% or more, and more preferably 80% or more. It is noted that the 60° specular glossiness can be measured according to JIS Z 8741.

The thickness of each of the first resin layer and the second resin layer is preferably 5 μm or more and 50 μm or less, and more preferably 8 μm or more and 40 μm or less. Basically, the thickness of the first and second resin layers can be appropriately determined based on a curling property pertaining to the thickness of the base. If the thickness of each of the first and second resin layers is 5 μm or more, increase of moisture or gas permeability through the resin surface and cracking of the ink-receiving layer caused by bending can be excellently prevented. Besides, if the thickness of each of the first and second resin layers is 50 μm or less, lowering of an anti-curling property can be effectively prevented to effectively avoid difficulty in handling.

A resin constituting each of the first and second resin layers can be at least one of a low-density polyethylene (LDPE) and a high-density polyethylene (HDPE). Alternatively, another linear low-density polyethylene (LLDPE), polypropylene or the like can be used.

Each of the first and second resin layers can contain a rutile or anatase type titanium oxide, a fluorescent whitening agent or an ultramarine blue pigment. Thus, the opacity, the whiteness and the hue can be improved. Here, the content of titanium oxide in each of the first and second resin layers is preferably 3 parts by mass or more and 20 parts by mass or less, and more preferably 4 parts by mass or more and 13 parts by mass or less based on 100 parts by mass of the whole resin contained in the resin layer.

The surface properties (i.e., the 60° specular glossiness) of each of the first and second resin layers can be controlled by, for example, pressing the resin layer against a cooling roll having been subjected to any of various surface treatments such as a mirror surface treatment and a fine roughening treatment when the resin layer is coated by melt extruding the resin onto the surface of the base.

Porous Undercoating Layer

The recording medium of the present embodiment includes the porous undercoating layer at least between the first resin layer and the first ink-receiving layer on one of the surfaces of the base. In other words, one of the opposing surfaces of the porous undercoating layer is in contact with the first resin layer while the other surface is in contact with the first ink-receiving layer.

Since the porous undercoating layer is provided on the base, fine irregularities and voids are formed. Therefore, the air can be satisfactorily released from between the front surface and the back surface of the recording medium being wound in the winding process, and in addition, the friction coefficient between the front surface and the back surface can be lowered, and the shape of a roll obtained by winding can be satisfactorily retained. As a result, good windability can be attained. Besides, the porous undercoating layer has a thickness of 3 μm or less. If the thickness of the porous undercoating layer exceeds 3 μm, gas-liquid exchange is caused between the air contained in the porous undercoating layer and a coating liquid for the first ink-receiving layer in applying and forming the first ink-receiving layer on the porous undercoating layer. Accordingly, if the amount of the air is large, bubbles are generated, which may disadvantageously cause a defect in the coated surface of the first ink-receiving layer in some cases.

Since the porous undercoating layer is porous, the average refractive indexes, inclusive of the voids, of the porous undercoating layer and the first ink-receiving layer are close to each other. Accordingly, when the first ink-receiving layer is provided on the porous undercoating layer, these layers can be optically substantially equivalent to each other. As a result, the irregularities on the front surface of the porous undercoating layer become substantially invisible, so that the glossiness can be improved. For obtaining the porous undercoating layer, an inorganic particle and a binder can be contained.

The pore volume Vs (ml/g) of the porous undercoating layer and the pore volume Vc (ml/g) of the first ink-receiving layer can satisfy the following expression (1):

$$0.7\ Vc<Vs<1.3\ Vc \quad (1)$$

When the above-described expression (1) is satisfied, the average refractive indexes, inclusive of the voids, of the porous undercoating layer and the first ink-receiving layer are close to each other, and thus these layers can be more effectively made optically equivalent to each other. The pore volume of the porous undercoating layer can be 0.3 ml/g or more and 1.5 ml/g or less.

The average pore radius of the porous undercoating layer can be 5 nm or more and 50 nm or less. If the average pore radius is 5 nm or more, the effect is exhibited for the air release in the winding process, and if the average pore radius is 50 nm or less, excellent glossiness can be attained. Incidentally, the average pore radius of the porous undercoating layer is more preferably 15 nm or more. If the average pore radius is 15 nm or more, a higher effect to release the air can be attained, and better windability can be exhibited.

The average pore radius of the porous undercoating layer can be smaller than the average pore radius of the first ink-receiving layer. Thus, the glossiness of the recording medium can be increased, and a good ink absorbing property can be attained. Incidentally, the pore volume and the average pore radius of each of the porous undercoating layer and the first ink-receiving layer can be measured by the methods described later in the discussion of Examples, below.

Besides, a case where the porous undercoating layer is provided between the first resin layer and the first ink-receiving layer on one of the two surfaces of the base has been described so far. The porous undercoating layer may be, however, further provided between the second resin layer and the second ink-receiving layer on the other surface of the base. In this case, the porous undercoating layer provided on the other surface of the base is preferably provided with the above-described characteristics. When the porous undercoating layer is thus also provided between the second resin layer and the second ink-receiving layer, the windability in the winding process performed for producing the recording medium can be further improved.

Furthermore, the porous undercoating layer may contain the following materials (A) to (C):

(A) Inorganic Particle

As the inorganic particles used in the porous undercoating layer, any of inorganic particles used in the first and second ink-receiving layers described later can be used. Incidentally, the inorganic particles used in the porous undercoating layer may be different from the inorganic particles used in the first and second ink-receiving layers. The porous undercoating layer can use, however, the same type of inorganic particles as those used in the first and second ink-receiving layers. Thus, when providing the first ink-receiving layer on the porous undercoating layer, an interface between the first ink-receiving layer and the porous undercoating layer becomes unclear. As a result, scattering on the surface of the porous undercoating layer is suppressed, so that good glossiness can be easily attained.

(B) Particle Having Average Secondary Particle Size of 0.5 μm or More

The porous undercoating layer can further contain particles having an average secondary particle size of 0.5 μm or more in a content of 0.1% by mass or more and 10% by mass or less. As the particles having an average secondary particle size of 0.5 μm or more, the aforementioned inorganic particles can be used, and wet process silica can be suitably used. In addition to this, organic resin particles or the like can be used as the particles having an average secondary particle size of 0.5 μm or more. The average secondary particle size is preferably 0.5 μm or more and 5 μm or less. If the average secondary particle size is 0.5 μm or more, the formation of irregularities on the surface of the porous undercoating layer is accelerated, so that the air can be more satisfactorily released from between the front surface and the back surface of the recording medium under production in the winding process. If the average secondary particle size is 5 μm or less, owing to the thickness (of 3 μm or less) of the porous undercoating layer, the particles can be supported within the porous undercoating layer without coming off from the porous undercoating layer. Incidentally, the average secondary particle size refers to an equivalent particle diameter measured by a pore electric resistance method based on the Coulter theory. The average secondary particle size can be measured by using, for example, Multisizer 3 (manufactured by Beckman Coulter, Inc.).

Besides, since the content of the particles in the porous undercoating layer is 0.1% by mass or more, the formation of the irregularities on the surface of the porous undercoating layer can be effectively accelerated through the addition of the particles. Since the content of the particles is 10% by mass or less, the irregularities are not excessively formed on the front surface of the porous undercoating layer, so that reduction in glossiness of the recording medium can be prevented.

(C) Binder

As a binder to be used in the porous undercoating layer, any of binders for the first and second ink-receiving layers described below can be used. It is noted that the binder for the porous undercoating layer may be different from that used for the first and second ink-receiving layers. However, similarly to the inorganic particles as described above, the same type of binder can be suitably used for the porous undercoating layer and the first and second ink-receiving layers. Thus, when providing the first ink-receiving layer on the porous undercoating layer, the interface between the first ink-receiving layer and the porous undercoating layer becomes unclear. As a result, scattering on the surface of the porous undercoating layer is suppressed, so that good glossiness can be easily attained.

First and Second Ink-Receiving Layers

Each of the first and second ink-receiving layers can be a porous type ink-receiving layer including voids from the viewpoint of the ink absorbing property. In this case, the pore volume of each of the first and second ink-receiving layers is preferably 0.3 ml/g or more and 1.5 ml/g or less. Since the pore volume is 0.3 ml/g or more, the ink absorbing property is improved, and since the pore volume is 1.5 ml/g or less, the mechanical strength of the ink-receiving layer can be improved to be difficult to damage. The material to form the porous type ink-receiving layer can include inorganic particles, a binder and the like. Materials (D) to (G) of each of the first and second ink-receiving layers will now be described.

(D) Inorganic Particle

Examples of the material of the inorganic particles include alumina, an alumina hydrate, light calcium carbonate, heavy calcium carbonate, magnesium carbonate, kaolin, aluminum silicate, diatomite, calcium silicate, magnesium silicate, synthetic amorphous silica, colloidal silica and magnesium hydroxide. From the viewpoint of print density, color developability and glossiness, alumina, an alumina hydrate, and synthetic amorphous silica can be used, and gas phase process silica can be particularly suitably used.

The average primary particle size of such inorganic particles is preferably 50 nm or less, and inorganic particles pulverized into an average secondary particle size of 500 nm or less can be used from the viewpoint of color developability and glossiness.

(E) Binder

As a binder, a material capable of binding the inorganic particles to form a coating film and not impairing the effects of the present invention can be used. Examples of the binder include the following:

Starch derivatives such as oxidized starch, etherified starch and phosphorylated starch;

cellulose derivatives such as carboxymethyl cellulose and hydroxyethyl cellulose;

casein, gelatin, soybean protein, polyvinyl alcohol and derivatives thereof;

conjugated polymer latexes such as polyvinyl pyrrolidone, a maleic anhydride resin, a styrene-butadiene copolymer and a methyl methacrylate-butadiene copolymer;

acrylic polymer latexes such as acrylate and methacrylate;

vinyl polymer latexes such as an ethylene-vinyl acetate copolymer;

functional-group-modified polymer latexes obtained by modifying the above-described binders with a monomer containing a functional group such as a carboxyl group;

binders obtained by cationizing the above-described binders with a cationic group or the above-described binders having surfaces cationized with a cationic surfactant;

binders obtained by polymerizing the above-described binders under cationic polyvinyl alcohol for distributing polyvinyl alcohol on the surfaces of resultant polymers;

binders obtained by polymerizing the above-described binders in dispersion liquids where cationic colloidal particles are suspended for distributing the cationic colloidal particles on the surfaces of resultant polymers;

water base binders of thermosetting synthetic resins such as a melamine resin and a urea resin;

polymer and copolymer resins of acrylates or methacrylates such as polymethyl methacrylate; and synthetic resin binders such as a polyurethane resin, an unsaturated polyester resin, a vinyl chloride-vinyl acetate copolymer, polyvinyl butyral and an alkyd resin.

One of these binders may be singly used, or a mixture of a plurality of these may be used.

Among the aforementioned binders, polyvinyl alcohol is most preferably used. The polyvinyl alcohol can be synthesized by, for example, hydrolyzing polyvinyl acetate. In particular, a completely or partially saponified polyvinyl alcohol or cationically modified polyvinyl alcohol is preferably used from the viewpoint of the ink absorbing property. Besides, from the viewpoint of water resistance and color developability, a polyvinyl alcohol having a weight-average degree of polymerization of 2000 or more and a degree of saponification of 85 mol % or more and 98 mol % or less is more preferably used. Furthermore, the weight-average degree of polymerization is particularly preferably 2000 or more and 5000 or less.

Incidentally, the degree of saponification of the polyvinyl alcohol is a value measured by a method according to JIS-K6726 (1994). Chemically, the degree of saponification refers to the proportion of the number of moles of hydroxyl groups generated through a saponification reaction performed in obtaining the polyvinyl alcohol by saponifying polyvinyl acetate. The average degree of polymerization of the polyvinyl alcohol refers to an average degree of polymerization obtained by a method according to JIS-K6726 (1994).

As the cationically modified polyvinyl alcohol, for example, one described in Japanese Patent Application Laid-Open No. S61-10483 can be used. Specifically, a polyvinyl alcohol having a primary to tertiary amino group or a quaternary ammonium group on a main chain or a side chain thereof can be used.

In forming the first and second ink-receiving layers, the polyvinyl alcohol can be used in a state of an aqueous solution. The dry solid content concentration of the polyvinyl alcohol in a polyvinyl-alcohol-containing aqueous solution is preferably 3% by mass or more and 20% by mass or less. When the concentration is within this range, it is possible to effectively prevent considerable reduction in the drying speed caused by excess reduction in the concentration of the coating liquid for the first and second ink-receiving layers. Besides, on the contrary, it is possible to inhibit such a situation that the viscosity of the coating liquid is greatly increased due to an increase of the concentration of the coating liquid, thereby impairing smoothness of the coated surface.

The content of the binder is, from the viewpoint of the ink absorbing property, preferably 50 parts by mass or less and more preferably 30 parts by mass or less based on 100 parts by mass of the total content of the inorganic particles. Besides, for binding each of the first and second ink-receiving layers, the content of the binder is preferably 5.0 parts by mass or more and more preferably 8 parts by mass or more based on 100 parts by mass of the inorganic particles.

(F) Crosslinking Agent

Each of the first and second ink-receiving layers can contain a crosslinking agent capable of crosslinking the binder, so as to be in a state of being cured by crosslinking. When the crosslinking agent is contained, the binder is prevented from swelling and filling the pores upon absorption of ink, and thus, a good ink absorbing property can be attained. Examples of the crosslinking agent include boric acid, borate and a water-soluble zirconium compound. Among these, boric acid and borate can be suitably used. In addition to these crosslinking agents, any of various crosslinking agents such as aldehydes like glyoxal can be used.

The content of the crosslinking agent in each of the first and second ink-receiving layers is preferably 1.0 part by mass or more and 50 parts by mass or less, and more preferably 5 parts by mass or more and 40 parts by mass or less based on 100 parts by mass of the binder contained in the ink-receiving layer.

(G) Additives

Each of the first and second ink-receiving layers may contain various additives if necessary. Examples of the additives include fixing agents such as various types of cationic resins, a flocculant such as a polyvalent metal salt, a surfactant, a fluorescent whitening agent, a thickening agent, an antifoaming agent, a foam inhibitor, a releasing agent, a penetrating agent, a lubricant, an ultraviolet absorber, an antioxidant, a leveling agent, an antiseptic agent and a pH adjusting agent.

2. Process for Producing Recording Medium

In a process for producing a recording medium of the present embodiment, a first resin layer having a 60° specular glossiness of 65% or more is formed on one surface of a base, and a second resin layer having a 60° specular glossiness of 65% or more is formed on the other surface of the base. Thereafter or before forming the second resin layer, a porous undercoating layer having a thickness of 3 μm or less is formed on the first resin layer. Next, the base having the first and second resin layers and the porous undercoating layer provided thereon is wound up into a roll. Subsequently, a first ink-receiving layer is formed on the porous undercoating layer of the base and a second ink-receiving layer is formed on the second resin layer of the base after winding up the base into a roll. In this manner, a recording medium is produced.

In a process for forming the first and second resin layers, for example, materials of the respective resin layers may be molten to be extrusion-coated on the both surfaces of the base. Alternatively, the first and second resin layers formed in advance may be bonded to the both surfaces of the base with adhesive layers disposed therebetween. The method for controlling the 60° specular glossiness of each of the surfaces of the first and second resin layers to be 65% or more is not especially limited, and the 60° specular glossiness can be controlled by, for example, adjusting the surface properties of the base and the first and second resin layers. More specifically, when the base is smoothed by surface treatment, the first and second resin layers formed thereon are affected by the surface properties of the base, and hence, the 60° specular glossiness can be easily increased. Alternatively, after forming the first and second resin layers, these resin layers may be pressed with a roller having a prescribed roughness, and thus, the 60° specular glossiness can be controlled to be a desired value of 65% or more. In the present embodiment, since the 60° specular glossiness of the surfaces of the first and second resin layers is 65% or more, the glossiness of the both surfaces of the recording medium can be made high.

Next, the porous undercoating layer having a thickness of 3 μm or less is formed on the first resin layer. As long as the thickness is 3 μm or less, a method for forming the porous undercoating layer is not especially limited. For example, a coating liquid containing a raw material of the porous undercoating layer may be prepared, and the coating liquid may be applied and dried on the first resin layer. Specifically, a method similar to a method for applying a coating liquid for the ink-receiving layer described later may be employed.

After forming the porous undercoating layer, the base having the first and second resin layers and the porous undercoating layer provided thereon is wound up into a roll. In the production of a recording medium, for improving the productivity, the recording medium is produced into a long sheet shape and then the sheet-shaped recording medium is cut into a desired size to obtain a product. Therefore, the base is wound up into a roll after forming the porous undercoating layer in order that the recording medium can be produced in a space-saving manner. Such a winding process is a process of winding the base into a roll before forming the first and second ink-receiving layers. In the winding process, a winding core is generally used, and the base is wound up around the winding core into a roll. A winding core having a diameter of approximately 50 mm or more and 300 mm or less is generally used. The winding tension is 50 N/m or more and 500 N/m or less, and more preferably 100 N/m or more and 400 N/m or less. Since the winding tension is 50 N/m or more, winding deviation can be prevented, and since the winding tension is 500 N/m or less, blocking due to tight winding can be prevented. Besides, the winding tension may be constant from the beginning to the end of the winding process, or may be gradually reduced toward the end of the winding process for avoiding pressure concentration at a winding starting portion. Besides, a touch roll may be used for winding the base while pressing the base.

In the present embodiment, since the porous undercoating layer is formed on the base in the winding process, fine irregularities and voids are formed. Therefore, the air can be satisfactorily released from between the front surface and the back surface of the base being wound in the winding process, the friction coefficient between the front surface and the back surface can be lowered, and the shape of a roll obtained by winding can be satisfactorily retained. As a result, good windability can be attained. Besides, since the thickness of the porous undercoating layer is 3 μm or less, occurrence of a defect in the first ink-receiving layer can be prevented.

Next, a first ink-receiving layer is formed on the porous undercoating layer, and a second ink-receiving layer is formed on the second resin layer of the base. The first and second ink-receiving layers can be formed, for example, as follows: coating liquids each obtained by mixing a pigment, a binder, a crosslinking agent, a pH adjusting agent, various additives, water and the like as needed are prepared for each of the ink-receiving layers. These coating liquids are applied respectively on the porous undercoating layer and the second resin layer. For applying the coating liquid, for example, any of various curtain coaters, an extrusion type coater and a slide hopper type coater can be used, and the application is performed by on-machine coating or off-machine coating. In the application, each coating liquid may be heated or a coater head to be used may be heated for the purpose of, for example, controlling the viscosity of the coating liquid. Besides, after the application, the coating liquid is dried by using, for example, a hot air dryer such as a straight drying tunnel, an arch dryer, an air loop dryer or a sine-curve air float dryer. Alternatively, an infrared radiation, a heating dryer, a dryer using microwaves or the like may be used.

EXAMPLES

The present invention will now be described in detail with reference to Examples and Comparative Examples, but it is noted that the contents of the present invention are not limited to the following Examples. Incidentally, "part(s)" or "%" used in the following description is on a mass basis unless otherwise mentioned.

Production of Base A

A base A was prepared as follows: first, a paper stock having the following composition was prepared to have a solid content concentration of 3.0% by using water.

| | |
|---|---|
| Pulp (containing Laubholz Bleached Kraft Pulp (LBKP) (80 parts) with a freeness of 450 ml CSF (Canadian Standard Freeness) and Nadelholz Bleached Kraft Pulp (NBKP) (20 parts) with a freeness of 480 ml CSF) | 100 parts |

-continued

| | |
|---|---|
| Cationized starch | 0.6 part |
| Heavy calcium carbonate | 10 parts |
| Light calcium carbonate | 15 parts |
| Alkylketene dimer | 0.1 part |
| Cationic polyacrylamide | 0.03 part |

Next, this paper stock was made into paper by using a Fourdrinier paper machine, and the resultant was subjected to three-stage wet pressing and then dried with a multi-cylinder dryer. Thereafter, an oxidized starch aqueous solution was impregnated to attain a solid content of 1.0 g/m$^2$ by using a size press machine, and the resultant was dried. Then, the resultant was subjected to machine calendering, and thus, a base A having a basis weight of 100 g/m$^2$ was prepared.

Preparation of Alumina Hydrate Dispersion Liquid 1

To 333 parts of ion-exchanged water, 1.5 parts of methanesulfonic acid was added as a deflocculating acid. The resultant methanesulfonic acid aqueous solution was stirred under the rotating condition of 3000 rpm by using a homomixer (trade name: T. K. Homomixer MARKII 2.5 type, manufactured by Tokushu Kika Kogyo Co., Ltd.). While continuing the stirring, 100 parts of an alumina hydrate (DISPERAL HP14, manufactured by Sasol Ltd.) was gradually added to the methanesulfonic acid aqueous solution. After completely adding the alumina hydrate, the resultant aqueous solution was continuously stirred for 30 minutes, and thus, an alumina hydrate dispersion liquid 1 having a solid content concentration of 23% was prepared.

Preparation of Alumina Hydrate Dispersion Liquid 2

To 333 parts of ion-exchanged water, 2.5 parts of methanesulfonic acid was added as a deflocculating acid. The resultant methanesulfonic acid aqueous solution was stirred under the rotating condition of 3000 rpm by using a homomixer (trade name: T. K. Homomixer MARKII 2.5 type, manufactured by Tokushu Kika Kogyo Co., Ltd.). While continuing the stirring, 100 parts of an alumina hydrate (DISPERAL HP10, manufactured by Sasol Ltd.) was gradually added to the methanesulfonic acid aqueous solution. After completely adding the alumina hydrate, the resultant aqueous solution was continuously stirred for 30 minutes, and thus, an alumina hydrate dispersion liquid 2 having a solid content concentration of 23% was prepared.

Preparation of Alumina Hydrate Dispersion Liquid 3

To 333 parts of ion-exchanged water, 0.7 part of methanesulfonic acid was added as a deflocculating acid. The resultant methanesulfonic acid aqueous solution was stirred under the rotating condition of 3000 rpm by using a homomixer (trade name: T. K. Homomixer MARKII 2.5 type, manufactured by Tokushu Kika Kogyo Co., Ltd.). While continuing the stirring, 100 parts of an alumina hydrate (DISPERAL HP22, manufactured by Sasol Ltd.) was gradually added to the methanesulfonic acid aqueous solution. After completely adding the alumina hydrate, the resultant aqueous solution was continuously stirred for 30 minutes, and thus, an alumina hydrate dispersion liquid 3 having a solid content concentration of 23% was prepared.

Preparation of Gas Phase Process Silica Dispersion Liquid

To 415 parts of ion-exchanged water, 10 parts of a diallyldimethylammonium chloride polymer (trade name: Shallol DC902P, having a solid content of 50%, manufactured by Dai-ichi Kogyo Seiyaku Co., Ltd.) was added. The resultant aqueous solution was stirred at a rotation speed of 10000 rpm by using a homomixer (trade name: CREARMIX, manufactured by M Technique Co., Ltd.). While continuing the stirring, 100 parts of a gas phase process silica (AEROSIL 300, manufactured by Evonik Industries AG) was gradually added to the aqueous solution. After completely adding the gas phase process silica, the resultant aqueous solution was continuously stirred for 60 minutes, and thus, a gas phase process silica dispersion liquid having a solid content concentration of 20% was prepared.

Preparation of Wet Process Silica Dispersion Liquid 1

To 667 parts of ion-exchanged water, stirring was conducted under the rotating condition of 3000 rpm by using a homomixer (trade name: T. K. Homomixer MARKII 2.5 type, manufactured by Tokushu Kika Kogyo Co., Ltd.). While continuing the stirring, 100 parts of a wet process silica (Fine Seal X-37, having an average secondary particle size of 2.6 μm, manufactured by Tokuyama Corporation) was gradually added to the aqueous solution. After completely adding the wet process silica, the resultant aqueous solution was continuously stirred for 30 minutes, and thus, a wet process silica dispersion liquid 1 having a solid content concentration of 15% was prepared. This wet process silica corresponds to "particles having an average secondary particle size of 0.5 μm or more" set forth in the appended claims.

Preparation of Wet Process Silica Dispersion Liquid 2

To 667 parts of ion-exchanged water, stirring was conducted under the rotating condition of 3000 rpm by using a homomixer (trade name: T. K. Homomixer MARKII 2.5 type, manufactured by Tokushu Kika Kogyo Co., Ltd.). While continuing the stirring, 100 parts of a wet process silica (Fine Seal T-32, having an average secondary particle size of 1.5 μm, manufactured by Tokuyama Corporation) was gradually added to the aqueous solution. After completely adding the wet process silica, the resultant aqueous solution was continuously stirred for 30 minutes, and thus, a wet process silica dispersion liquid 2 having a solid content concentration of 15% was prepared. This wet process silica corresponds to "particles having an average secondary particle size of 0.5 μm or more" set forth in the appended claims.

Preparation of Coating Liquid

Each coating liquid was prepared to have the following composition. It is noted that the number of parts of each component of the coating liquid is a value obtained by regarding the total solid content of a pigment as 100 parts.

| Coating Liquid 1 | |
|---|---|
| Alumina hydrate dispersion liquid 1 (having a solid content of 23%) | 441 parts |
| Polyvinyl alcohol aqueous solution (PVA 235, manufactured by Kuraray Co., Ltd., having a weight-average degree of polymerization of 3500, a degree of saponification of 88 mol %, and a solid content of 8%) | 125 parts |
| Orthoboric acid aqueous solution (having a solid content of 5%) | 20 parts |

Water was further added to these components to attain a solid content of 18% as a whole. To the resulting mixture, a surfactant (Surfynol 465) was added in a concentration of 0.1%, and thus, a coating liquid 1 was prepared.

| Coating Liquid 2 | |
|---|---|
| Alumina hydrate dispersion liquid 1 (having a solid content of 23%) | 441 parts |
| Polyvinyl alcohol aqueous solution (PVA 235, manufactured by Kuraray Co., Ltd., having a weight-average degree of polymerization of 3500, a degree of saponification of 88 mol %, and a solid content of 8%) | 250 parts |

-continued

| Coating Liquid 2 | |
|---|---|
| Orthoboric acid aqueous solution (having a solid content of 5%) | 20 parts |

Water was further added to these components to attain a solid content of 16% as a whole. To the resulting mixture, a surfactant (Surfynol 465) was added in a concentration of 0.1%, and thus, a coating liquid 2 was prepared.

| Coating Liquid 3 | |
|---|---|
| Polyvinyl alcohol aqueous solution (PVA 235, manufactured by Kuraray Co., Ltd., having a weight-average degree of polymerization of 3500, a degree of saponification of 88 mol %, and a solid content of 8%) | 125 parts |
| Orthoboric acid aqueous solution (having a solid content of 5%) | 20 parts |

Water was further added to these components to attain a solid content of 5% as a whole. To the resulting mixture, a surfactant (Surfynol 465) was added in a concentration of 0.1%, and thus, a coating liquid 3 was prepared.

| Coating Liquid 4 | |
|---|---|
| Gas phase process silica dispersion liquid (having a solid content of 20%) | 525 parts |
| Polyvinyl alcohol aqueous solution (PVA 235, manufactured by Kuraray Co., Ltd., having a weight-average degree of polymerization of 3500, a degree of saponification of 88 mol %, and a solid content of 8%) | 188 parts |
| Orthoboric acid aqueous solution (having a solid content of 5%) | 60 parts |

Water was further added to these components to attain a solid content of 14% as a whole. To the resulting mixture, a surfactant (Surfynol 465) was added in a concentration of 0.1%, and thus, a coating liquid 4 was prepared.

| Coating Liquid 5 | |
|---|---|
| Alumina hydrate dispersion liquid 1 (having a solid content of 23%) | 441 parts |
| Wet process silica dispersion liquid 1 (having a solid content of 15%) | 6.7 parts |
| Polyvinyl alcohol aqueous solution (PVA 235, manufactured by Kuraray Co., Ltd., having a weight-average degree of polymerization of 3500, a degree of saponification of 88 mol %, and a solid content of 8%) | 125 parts |
| Orthoboric acid aqueous solution (having a solid content of 5%) | 20 parts |

Water was further added to these components to attain a solid content of 18% as a whole. To the resulting mixture, a surfactant (Surfynol 465) was added in a concentration of 0.1%, and thus, a coating liquid 5 was prepared.

Coating Liquid 6

A coating liquid 6 was prepared in the same manner as the coating liquid 5 except that the wet process silica dispersion liquid 1 was replaced with the wet process silica dispersion liquid 2.

Coating Liquid 7

A coating liquid 7 was prepared in the same manner as the coating liquid 6 except that the content of the wet process silica dispersion liquid 2 was changed to 1.3 parts.

Coating Liquid 8

A coating liquid 8 was prepared in the same manner as the coating liquid 6 except that the content of the wet process silica dispersion liquid 2 was changed to 66.7 parts.

Coating Liquid 9

A coating liquid 9 was prepared in the same manner as the coating liquid 1 except that the alumina hydrate dispersion liquid 1 was replaced with the alumina hydrate dispersion liquid 2.

Coating Liquid 10

A coating liquid 10 was prepared in the same manner as the coating liquid 1 except that the alumina hydrate dispersion liquid 1 was replaced with the alumina hydrate dispersion liquid 3.

| Coating Liquid 11 | |
|---|---|
| Alumina hydrate dispersion liquid 1 (having a solid content of 23%) | 441 parts |
| Polyvinyl alcohol aqueous solution (PVA 235, manufactured by Kuraray Co., Ltd., having a weight-average degree of polymerization of 3500, a degree of saponification of 88 mol %, and a solid content of 8%) | 625 parts |
| Orthoboric acid aqueous solution (having a solid content of 5%) | 100 parts |

Water was further added to these components to attain a solid content of 13% as a whole. To the resulting mixture, a surfactant (Surfynol 465) was added in a concentration of 0.1%, and thus, a coating liquid 11 was prepared.

Example 1

A polyethylene resin composition containing a low-density polyethylene (70 parts), a high-density polyethylene (20 parts) and titanium oxide (10 parts) and having been molten at 320° C. was extrusion-coated on both surfaces of the base A so as to have a thickness of 30 μm. Next, the resultant surfaces of the base were transferred onto the surface of a mirror-surface cooling drum, so as to obtain a base having smooth first and second resin layers on both surfaces thereof. Subsequently, the surfaces of the first and second resin layers were subjected to a corona discharge treatment. Thereafter, the coating liquid 1 was applied to the both surfaces in an amount of 2.8 g/m$^2$ by using a bar coater, and dried with a hot air dryer, and thus, a porous undercoating layer having a thickness of 0.5 μm was formed on each of the first and second resin layers. Next, the base having the first and second resin layers and the porous undercoating layers formed thereon was wound up at a speed of 250 m/min. Incidentally, the 60° specular glossiness of the first and second resin layers measured before forming the porous undercoating layer was 83%.

Next, the coating liquid 1 was applied on the both porous undercoating layers in an amount of 194 g/m$^2$ by using a slide die, and dried with a hot air dryer, and thus, first and second ink-receiving layers each having a thickness of 35 μm were formed. In this manner, an ink jet recording medium was obtained.

Example 2

An ink jet recording medium was produced in the same manner as in Example 1 except that a cooling drum having a slightly rougher surface characteristic as compared with that used in Example 1 was used to attain a 60° specular glossiness of 70% of the surfaces of the first and second resin layers.

Example 3

An ink jet recording medium was produced in the same manner as in Example 1 except that a cooling drum having a slightly rougher surface characteristic as compared with that used in Example 2 was used to attain a 60° specular glossiness of 65% of the surfaces of the first and second resin layers.

Example 4

An ink jet recording medium was produced in the same manner as in Example 1 except that the thickness of the porous undercoating layer was set to 0.1 μm.

Example 5

An ink jet recording medium was produced in the same manner as in Example 1 except that the thickness of the porous undercoating layer was set to 0.3 μm.

Example 6

An ink jet recording medium was produced in the same manner as in Example 1 except that the thickness of the porous undercoating layer was set to 2 μm.

Example 7

An ink jet recording medium was produced in the same manner as in Example 1 except that the coating liquid used for forming the porous undercoating layer was changed to the coating liquid 2.

Example 8

An ink jet recording medium was produced in the same manner as in Example 1 except that the coating liquid used for forming the porous undercoating layer was changed to the coating liquid 4.

Example 9

An ink jet recording medium was produced in the same manner as in Example 1 except that the porous undercoating layer was provided only between the first resin layer and the first ink-receiving layer.

Example 10

An ink jet recording medium was produced in the same manner as in Example 1 except that the coating liquid used for forming the porous undercoating layer was changed to the coating liquid 5.

Example 11

An ink jet recording medium was produced in the same manner as in Example 1 except that the coating liquid used for forming the porous undercoating layer was changed to the coating liquid 6.

Example 12

An ink jet recording medium was produced in the same manner as in Example 1 except that the coating liquid used for forming the porous undercoating layer was changed to the coating liquid 7.

Example 13

An ink jet recording medium was produced in the same manner as in Example 1 except that the coating liquid used for forming the porous undercoating layer was changed to the coating liquid 8.

Example 14

An ink jet recording medium was produced in the same manner as in Example 1 except that the coating liquid used for forming the porous undercoating layer was changed to the coating liquid 9.

Example 15

An ink jet recording medium was produced in the same manner as in Example 1 except that the coating liquid used for forming the porous undercoating layer was changed to the coating liquid 10.

Comparative Example 1

An ink jet recording medium was produced in the same manner as in Example 1 except that no porous undercoating layer was provided.

Comparative Example 2

An ink jet recording medium was produced in the same manner as in Example 1 except that the coating liquid used for forming the porous undercoating layer was changed to the coating liquid 3.

Comparative Example 3

An ink jet recording medium was produced in the same manner as in Example 1 except that a cooling drum having a rougher surface characteristic as compared with that used in Example 3 was used to attain a 60° specular glossiness of 58% of the surfaces of the first and second resin layers.

Comparative Example 4

An ink jet recording medium was produced in the same manner as in Example 1 except that the coating liquid used for forming the porous undercoating layer was changed to the coating liquid 11, and that the coating amount of the coating liquid 11 was set to 3.9 g/m$^2$.

Comparative Example 5

An ink jet recording medium was produced in the same manner as in Example 1 except that the thickness of the porous undercoating layer was set to 4 μm.

The results of evaluations of the respective ink jet recording media produced as described above are shown in Table 1. The evaluations were performed as follows:

(1) 60° Specular Glossiness

The 60° specular glossiness of the surfaces of the first and second resin layers was measured according to JIS Z 8741.

(2) Pore Volume and Average Pore Radius of Porous Undercoating Layer and Ink-Receiving Layer For measuring the average pore radius, an automatic specific surface area/porosimetry analyzer, TriStar 3000 manufactured by Shimadzu Corporation was used. Besides, for a pretreatment of a sample, Vacu-Prep 061 manufactured by Shimadzu Corporation was used.

The measurement was performed as follows: each of the coating liquids used for forming the porous undercoating layers and the ink-receiving layers in the examples and comparative examples was applied onto a resin coated paper sheet to have a thickness of 35 μm, and the resultant sheet was cut into a size of 5.0×10 cm. Thereafter, the cut sheet was further cut into a size sufficient to put into a ⅜ inch cell used for measuring the average pore radius. Then, the thus obtained sample was put into the cell to be degassed and dried, by using Vacu-Prep 061 according to an appended manual, until the pressure was lowered to 20 mTorr or less while heating at 80° C.

The sample resulting from the degassing and drying was subjected to measurement of the average pore radius by using Tri-Star 3000 according to an appended manual by the nitrogen absorption desorption method. After the measurement, the thus obtained data on the nitrogen desorption side was used for finally obtaining values of the pore volume and the average pore radius. As the average pore radius, a peak value of the pore radius obtained from a chart in which the pore radius and the volume are plotted as frequency was used.

Incidentally, it was confirmed through preliminary examination that the pore volume and the average pore radius of the porous undercoating layer were affected neither by the type, the surface property or the thickness of the base nor by the thickness of the porous undercoating layer. It was also confirmed that the pore volume and the average pore radius of the ink-receiving layer were affected by none of the type, the surface property or the thickness of the base, the type, the thickness or the surface property of the porous undercoating layer, and the thickness of the ink-receiving layer. Furthermore, in each of Examples 1 to 8, 10 to 15, and Comparative Example 2 to 5, the two porous undercoating layers provided on the both surfaces of the base have the same constitution, and therefore, the porous volumes and the average pore radiuses of these layers are shown as the results of a single layer of the "porous undercoating layer" in Table 1. Similarly, in each of Examples 1 to 15 and Comparative Examples 2 to 5, the two ink-receiving layers provided on the both surfaces of the base have the same constitution, and therefore, the porous volumes and the average pore radiuses of these layers are shown as the results of a single layer of the "ink-receiving layer" in Table 1. Besides, since no porous undercoating layer was formed in Comparative Example 1, the pore volume and the average pore radius of the ink-receiving layer of Comparative Example 1 are not shown in Table 1. Furthermore, since the undercoating layer was not porous in each of Comparative Examples 2 and 4, the pore volume and the average pore radius are shown as "0" in these comparative examples.

(3) Windability

The shape of a roll obtained by winding each base after forming the porous undercoating layer was visually checked to be evaluated based on the following criteria:

AA: The surface of the roll has substantially no unevenness, and there is no defect on the end surfaces of the roll.

A: The surface of the roll has substantially no unevenness, but there are slight defects on the end surfaces of the roll.

B: The surface of the roll is slightly deformed, and there are slight defects on the end surfaces of the roll.

C: The surface of the roll is deformed, and the sheet itself is deformed.

(4) 20° Specular Glossiness of Ink-Receiving Layer

The 20° specular glossiness of the surface of each ink-receiving layer was measured according to JIS Z 8741. Incidentally, in each of Examples 1 to 15 and Comparative Examples 1 to 5, the two ink-receiving layers provided on the both surfaces of the base have the same constituent, and therefore, the 20° specular glossiness of only one of the ink-receiving layers was measured.

(5) Defects in Ink-Receiving Layer

The surface of the first or second ink-receiving layer of the A4 size was visually observed for evaluation based on the following criteria. Incidentally, in each of Examples 1 to 15 and Comparative Examples 1 to 5, the two ink-receiving layers provided on the both surfaces of the base have the same constituent, and therefore, only one of the ink-receiving layers was observed.

A: Number of bubbles with a size of 0.5 mm or more is 3 or less.

B: Number of bubbles with a size of 0.5 mm or more is 4 or more and 10 or less.

C: Number of bubbles with a size of 0.5 mm or more is 10 or more.

(6) Thickness of Porous Undercoating Layer

The cross-section of each sample having the porous undercoating layer was observed with a microscope to measure thicknesses at arbitrary 10 positions, and the average of these thicknesses was taken as the thickness of the porous undercoating layer.

TABLE 1

| | 60° Specular glossiness | | Pore volume (ml/g) | | | Thickness of porous undercoating layer (μm) | | Average pore radius (nm) | | Evaluation results | | |
|---|---|---|---|---|---|---|---|---|---|---|---|---|
| | First resin layer | Second resin layer | Porous undercoating layer (Vs) | Ink-receiving layer (Vc) | Vs/vc | On first resin layer | On second resin layer | Porous undercoating layer | Ink-receiving layer | Windability | 20° Specular glossiness of ink-receiving layer | Defects in ink-receiving layer |
| Example 1 | 83 | 83 | 0.6 | 0.6 | 1 | 0.5 | 0.5 | 10 | 10 | A | 27 | A |
| Example 2 | 70 | 70 | 0.6 | 0.6 | 1 | 0.5 | 0.5 | 10 | 10 | A | 25 | A |
| Example 3 | 65 | 65 | 0.6 | 0.6 | 1 | 0.5 | 0.5 | 10 | 10 | A | 23 | A |
| Example 4 | 83 | 83 | 0.6 | 0.6 | 1 | 0.1 | 0.1 | 10 | 10 | B | 27 | A |
| Example 5 | 83 | 83 | 0.6 | 0.6 | 1 | 0.3 | 0.3 | 10 | 10 | A | 27 | A |
| Example 6 | 83 | 83 | 0.6 | 0.6 | 1 | 2 | 2 | 10 | 10 | A | 27 | B |
| Example 7 | 83 | 83 | 0.35 | 0.6 | 0.58 | 0.5 | 0.5 | 10 | 10 | B | 23 | A |
| Example 8 | 83 | 83 | 0.82 | 0.6 | 1.37 | 0.5 | 0.5 | 10 | 10 | A | 23 | A |
| Example 9 | 83 | 83 | 0.82 | 0.6 | 1.37 | 0.5 | — | 10 | 10 | B | 27 | A |
| Example 10 | 83 | 83 | 0.6 | 0.6 | 1 | 0.5 | 0.5 | 10 | 10 | AA | 25 | A |
| Example 11 | 83 | 83 | 0.6 | 0.6 | 1 | 0.5 | 0.5 | 10 | 10 | AA | 26 | A |
| Example 12 | 83 | 83 | 0.6 | 0.6 | 1 | 0.5 | 0.5 | 10 | 10 | A | 27 | A |

TABLE 1-continued

| | 60° Specular glossiness | | Pore volume (ml/g) | | | Thickness of porous undercoating layer (μm) | | Average pore radius (nm) | | Evaluation results | | |
|---|---|---|---|---|---|---|---|---|---|---|---|---|
| | First resin layer | Second resin layer | Porous undercoating layer (Vs) | Ink-receiving layer (Vc) | Vs/vc | On first resin layer | On second resin layer | Porous undercoating layer | Ink-receiving layer | Windability | 20° Specular glossiness of ink-receiving layer | Defects in ink-receiving layer |
| Example 13 | 83 | 83 | 0.6 | 0.6 | 1 | 0.5 | 0.5 | 10 | 10 | AA | 23 | A |
| Example 14 | 83 | 83 | 0.6 | 0.6 | 1 | 0.5 | 0.5 | 8 | 10 | AA | 28 | A |
| Example 15 | 83 | 83 | 0.6 | 0.6 | 1 | 0.5 | 0.5 | 17 | 10 | AA | 25 | A |
| Comparative Example 1 | 83 | 83 | — | — | — | — | — | — | — | C | 27 | B |
| Comparative Example 2 | 83 | 83 | 0 | 0.6 | 0 | 0.5 | 0.5 | 0 | 0 | C | 28 | A |
| Comparative Example 3 | 58 | 58 | 0.6 | 0.6 | 1 | 0.5 | 0.5 | 0.6 | 0.6 | A | 21 | A |
| Comparative Example 4 | 83 | 83 | 0 | 0.6 | 0 | 0.5 | 0.5 | 0 | 0 | A | 21 | A |
| Comparative Example 5 | 83 | 83 | 0.6 | 0.6 | 1 | 4 | 4 | 10 | 10 | A | 27 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-265291, filed Dec. 24, 2013, which is hereby incorporated by reference herein in its entirety.

What is claimed is:

1. A recording medium comprising:

a first resin layer provided on one surface of a base;

a porous undercoating layer provided on the first resin layer;

a first ink-receiving layer provided on the porous undercoating layer;

a second resin layer provided on the other surface of the base; and a second ink-receiving layer provided on the second resin layer, wherein a 60° specular glossiness of a surface of the first resin layer that is closer to the first ink-receiving layer is 65% or more, wherein a 60° specular glossiness of a surface of the second resin layer that is closer to the second ink-receiving layer is 65% or more, wherein the porous undercoating layer has a thickness of 3 μm or less, and wherein the porous undercoating layer has an average pore radius smaller than an average pore radius of the first ink-receiving layer.

2. The recording medium according to claim 1, wherein a pore volume Vs (ml/g) of the porous undercoating layer and a pore volume Vc (ml/g) of the first ink-receiving layer satisfy the following expression:

$$0.7\ Vc<Vs<1.3\ Vc.$$

3. The recording medium according to claim 1, wherein the porous undercoating layer contains particles having an average secondary particle size of 0.5 μm or more in a content of 0.1% by mass or more and 10% by mass or less.

4. The recording medium according to claim 1, wherein the porous undercoating layer has an average pore radius of 15 nm or more.

5. The recording medium according to claim 1, wherein a pore volume Vs (ml/g) of the porous undercoating layer is 0.3 ml/g or more and 1.5 ml/g or less.

6. A process for producing a recording medium, comprising:

forming a first resin layer having a 60° specular glossiness of 65% or more on one surface of a base;

forming a second resin layer having a 60° specular glossiness of 65% or more on the other surface of the base;

forming a porous undercoating layer having a thickness of 3 μm or less on the first resin layer;

rolling up the base on which the first and second resin layers and the porous undercoating layer have been provided; and forming a first ink-receiving layer on the porous undercoating layer and forming a second ink-receiving layer on the second resin layer after rolling up the base, wherein the porous undercoating layer has an average pore radius smaller than an average pore radius of the first ink-receiving layer.

* * * * *